US005505666A

United States Patent [19]

Arsenault

[11] Patent Number: 5,505,666

[45] Date of Patent: Apr. 9, 1996

[54] BOWLING BALL FINGER INSERT

[76] Inventor: Joseph M. Arsenault, 78 Wintergreen Ct., Harrison, Ohio 45030

[21] Appl. No.: 362,769

[22] Filed: Dec. 23, 1994

[51] Int. Cl.[6] ..... A63B 37/00

[52] U.S. Cl. ..... 473/129; 473/130

[58] Field of Search ..... 473/127, 128, 473/129, 130

[56] References Cited

U.S. PATENT DOCUMENTS 2,435,327 2/1948 Seurynck .
2,436,976 3/1948 Seurynck .
2,842,367 7/1958 Keith .
3,001,793 9/1961 Insetta .
3,137,505 6/1964 Coppola .
4,968,033 11/1990 Aluotto .

*Primary Examiner*—William M. Pierce

[57] ABSTRACT

An insert for adjustably sizing a finger or thumb hole of a bowling ball. The inventive device includes a cylindrical receiver securable within a hole of a bowling ball. A cylindrical insert of a desired size is positioned within the receiver to custom fit the bowling ball to an individual. A coupling assembly within the insert operates to securely and removably couple the insert to the receiver.

7 Claims, 3 Drawing Sheets

FIG 1
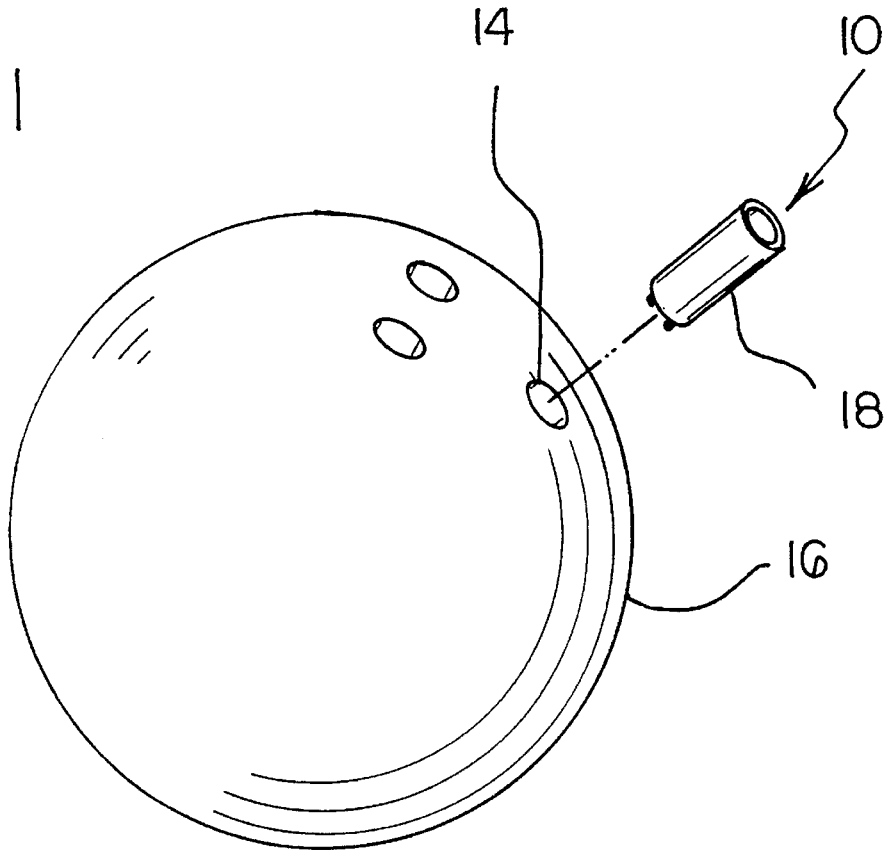
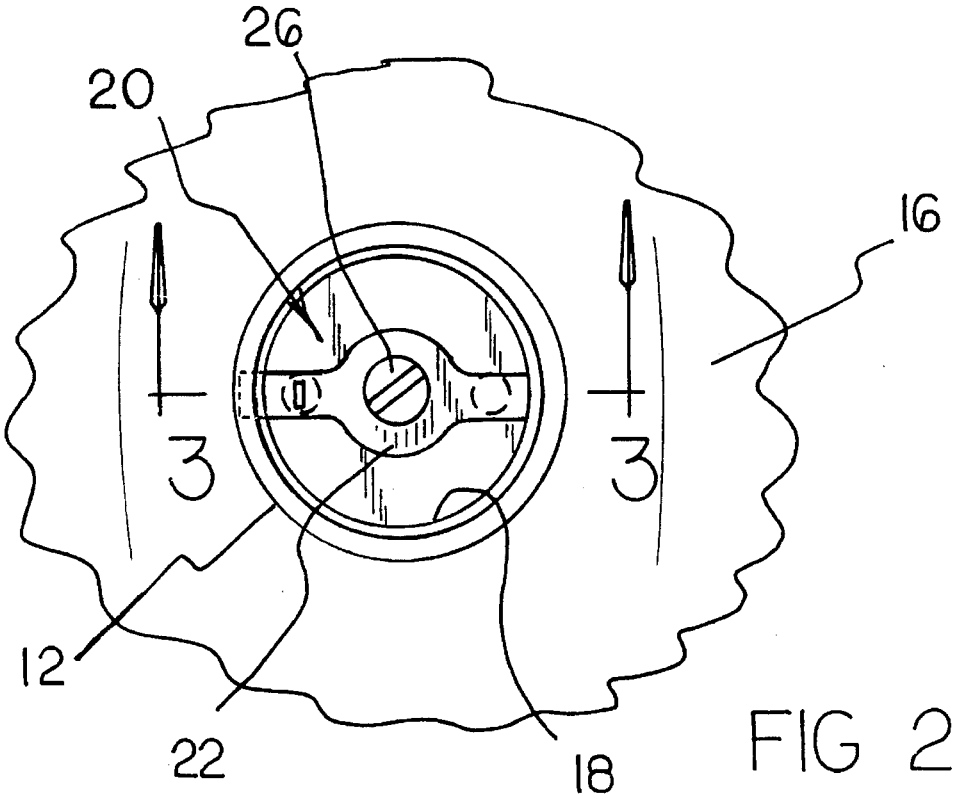
FIG 2

BOWLING BALL FINGER INSERT

BACKGROUND OF THE INVENTION

1. Field of the Invention

The present invention relates to bowling ball gripping devices and more particularly pertains to an bowling ball finger insert for adjustably sizing a finger or thumb hole of a bowling ball.

2. Description of the Prior Art

The use of bowling ball gripping devices is known in the prior art. More specifically, bowling ball gripping devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art bowling ball gripping devices include U.S. Pat. Nos. 4,416,452; 4,569,520; 4,530,502; 4,699,380; and 4,623,149.

While these devices fulfill their respective, particular objectives and requirements, the aforementioned patents do not disclose a bowling ball finger insert for a bowling ball finger insert for adjustably sizing a finger or thumb hole of a bowling ball which includes a cylindrical receiver securable within a hole of a bowling ball, a cylindrical insert positioned within the receiver, and coupling assembly movably mounted within the insert for securing the insert to the receiver.

In these respects, the bowling ball finger insert according to the present invention substantially departs from the conventional concepts and designs of the prior art, and in so doing provides an apparatus primarily developed for the purpose of adjustably sizing a finger or thumb hole of a bowling ball.

SUMMARY OF THE INVENTION

In view of the foregoing disadvantages inherent in the known types of bowling ball gripping devices now present in the prior art, the present invention provides a new bowling ball finger insert construction wherein the same can be utilized for adjustably sizing a finger or thumb hole of a bowling ball. As such, the general purpose of the present invention, which will be described subsequently in greater detail, is to provide a new bowling ball finger insert apparatus and method which has many of the advantages of the bowling ball gripping devices mentioned heretofore and many novel features that result in a bowling ball finger insert which is not anticipated, rendered obvious, suggested, or even implied by any of the prior art bowling ball gripping devices, either alone or in any combination thereof.

To attain this, the present invention generally comprises an insert for adjustably sizing a finger or thumb hole of a bowling ball. The inventive device includes a cylindrical receiver securable within a hole a of a bowling ball. A cylindrical insert of a desired size is positioned within the receiver to custom fit the bowling ball to an individual. A coupling assembly within the insert operates to securely and removably couple the insert to the receiver.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bowling ball finger insert apparatus and method which has many of the advantages of the bowling ball gripping devices mentioned heretofore and many novel features that result in a bowling ball finger insert which is not anticipated, rendered obvious, suggested, or even implied by any of the prior art bowling ball gripping devices, either alone or in any combination thereof.

It is another object of the present invention to provide a new bowling ball finger insert which may be easily and efficiently manufactured and marketed.

It is a further object of the present invention to provide a new bowling ball finger insert which is of a durable and reliable construction.

An even further object of the present invention is to provide a new bowling ball finger insert which is susceptible of a low cost of manufacture with regard to both materials and labor, and which accordingly is then susceptible of low prices of sale to the consuming public, thereby making such bowling ball finger inserts economically available to the buying public.

Still yet another object of the present invention is to provide a new bowling ball finger insert which provides in the apparatuses and methods of the prior art some of the advantages thereof, while simultaneously overcoming some of the disadvantages normally associated therewith.

Still another object of the present invention is to provide a new bowling ball finger insert for adjustably sizing a finger or thumb hole of a bowling ball.

Yet another object of the present invention is to provide a new bowling ball finger insert which includes a cylindrical receiver securable within a hole of a bowling ball, a cylindrical insert positioned within the receiver, and coupling assembly movably mounted within the insert for securing the insert to the receiver.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an exploded isometric illustration of a bowling ball finger insert according to the present invention in use.

FIG. 2 is an enlarged top plan view of the invention.

DESCRIPTION OF THE PREFERRED EMBODIMENT

Figure 3:
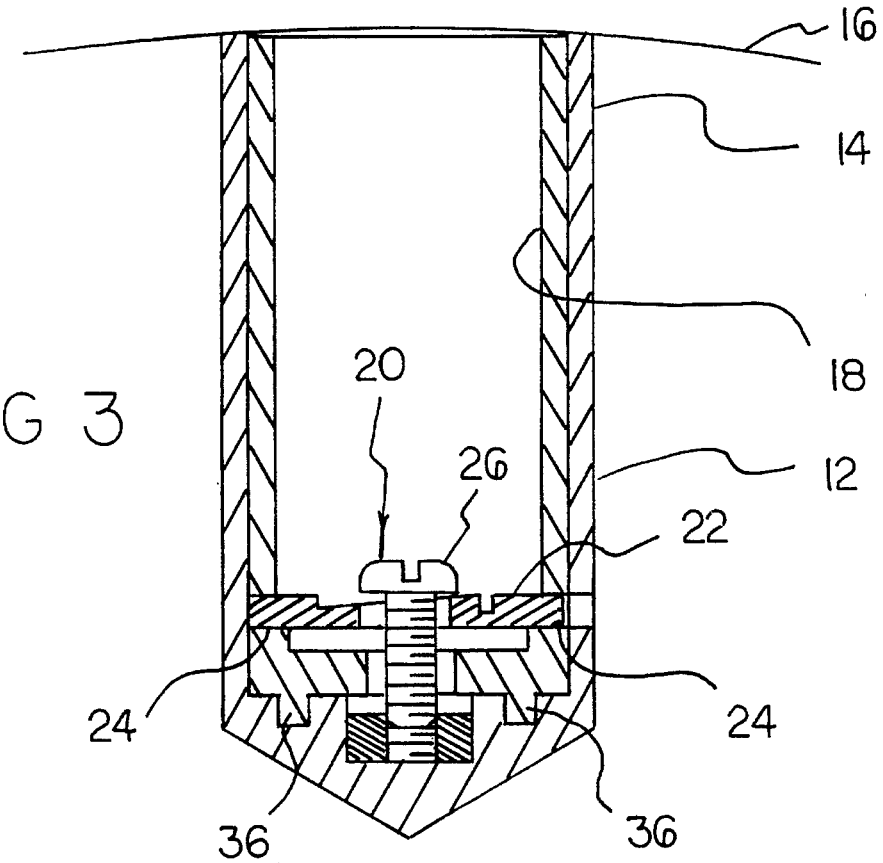
FIG. 3 is a cross sectional view taken along line 3—3 of FIG. 2.

With reference now to the drawings, and in particular to FIGS. 1–6 thereof, a new bowling ball finger insert embodying the principles and concepts of the present invention and generally designated by the reference numeral 10 will be described.

More specifically, it will be noted that the bowling ball finger insert 10 comprises a cylindrical receiver 12 positionable within a finger hole 14 of a bowling ball 16 utilized in association with the present invention 10. The cylindrical receiver 12 can be secured within the finger hole 14 of the bowling ball 16 by any conventional means, such as through a use of adhesives or mechanical fasteners. Further, it with the intent and purview of the present invention to secure the cylindrical receiver 12 within the finger hole 14 by a mechanical interference fit such as press fitting or other similar methods. A cylindrical insert 18 is positioned within the cylindrical receiver 12 and secured thereto by a coupling means 20 for securing the cylindrical insert within the cylindrical receiver. The cylindrical insert 18 can have any inside diameter permitting comfortable reception of an individual's finger or thumb therewithin. In other words, a variety of cylindrical inserts 18 can be provided each having a disparate interior diameter, whereby a desired cylindrical insert can be removably coupled within the cylindrical receiver 12 to size the bowling ball 16 to a particular individual.

Figure 4:
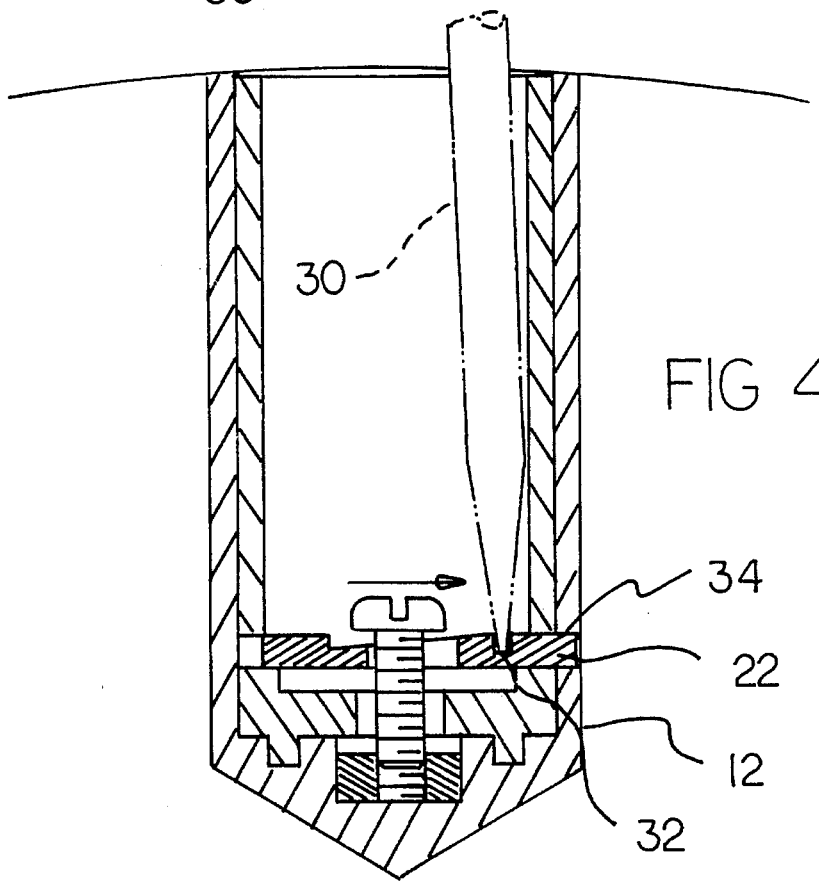
FIG. 4 is a cross sectional view of the invention.
Figure 5:
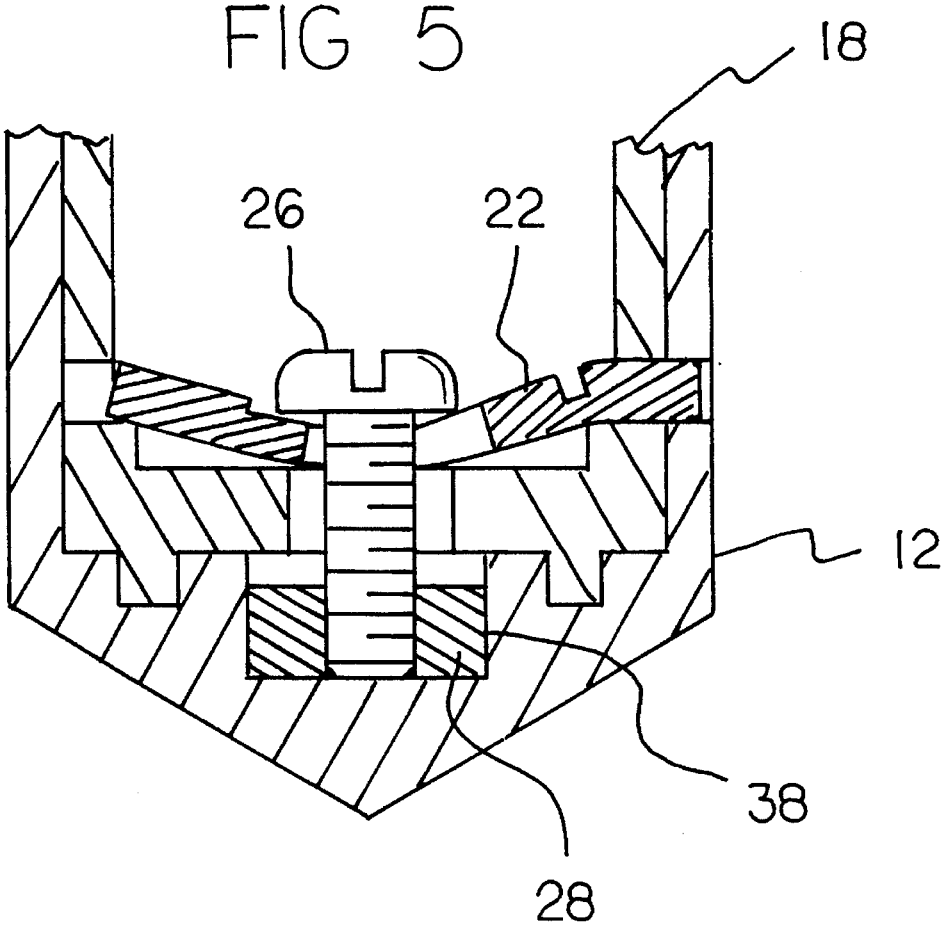
FIG. 5 is an enlarged cross section illustration of a portion of the present invention.

As best illustrated in FIGS. 2 through 6, it can be shown that the coupling means 20 according to the present invention 10 comprises a lock member 22 slidably positioned within diametrical opposed slots 24 formed in the cylindrical insert 18. The lock member 22 is provided with a through-extending aperture permitting the direction of a threaded fastener 26 through the lock member as shown in FIGS. 3 through 5. The threaded fastener 26 threadably engages a securing nut 28, whereby an axial advancing of the threaded fastener 26 into the securing nut 28 will effect securement of the lock member 22 in a desired position. As shown in FIG. 4, a tool 30 can be positioned within an engaging slot 32 formed in the lock member 20 to bias the lock member through one of the opposed slots 24 in the cylindrical insert 18 and into a receiving slot 34 formed in the cylindrical receiver 12. Thus, a tightening of the threaded fastener 26 as shown in FIG. 5, will resiliently deform the lock member 22 to couple the cylindrical insert 18 relative to the cylindrical receiver 12.

To facilitate alignment of one of the diametrical opposed slots 24 with the receiving slot 34 so as to permit reception of the lock member 22 therewithin, a plurality of guide projections 36 desirably extend from a bottom surface of the cylindrical insert 18 and are positioned for reception with an unlabeled and cooperatively configured apertures formed in the cylindrical receiver 12. To preclude an unintentional rotation of the securing nut 28 relative to a cylindrical insert 18 when the same is positioned within the cylindrical receiver 12, securing nut 28 is desirably received within a polygonal aperture 38 formed in the cylindrical receiver 12. By this configuration, the securing nut 28 can be removably received within the polygonal aperture to preclude rotation of the securing nut during tightening of the threaded fastener 26. Alternatively, the securing nut 28 can be fixedly secured within the polygonal aperture 38 through a use of adhesives or the like. Further, the threaded fastener 26, in lieu of the securing nut 28, may simply be threadably engaged to a threaded bore formed within the cylindrical receiver 12.

Figure 6:
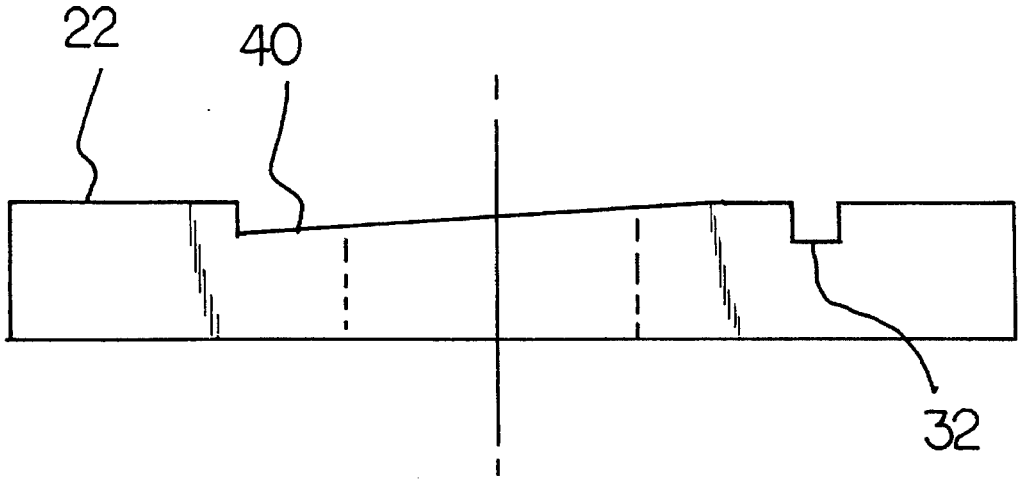
FIG. 6 is a side elevation view of a locking member comprising a portion of the present invention.

As shown in FIG. 6, the lock member 22 is preferably shaped so as to define an inclined upper surface 40 extending over the center aperture through which the threaded fastener 26 extends through the lock member. The inclined upper surface 40 operates to encourage positioning of the lock member 22 into the receiving slot 34 during securement of the coupling means 20 as described above.

In use, the bowling ball finger insert 10 according to the present invention can be easily coupled to an existing bowling ball 16 to facilitate custom fitting of the bowling ball to an individual's particular finger or thumb size. Further, should swelling of the individual's hand occur, separate and disparate cylindrical inserts 18 can be provided for interchanging during playing of a bowling game to accommodate such swelling. The coupling means 20 utilized in securing the cylindrical insert 18 within the cylindrical receiver 12 provides for three points through which force can be transmitted to the bowling ball 16 such that the cylindrical insert 18 will not move relative thereto.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bowling ball finger insert comprising:

a cylindrical receiver securable within a finger hole of a bowling ball;

a cylindrical insert positioned within the cylindrical receiver;

and, a coupling means for securing the cylindrical insert within the cylindrical receiver;

wherein the cylindrical insert is shaped so as to define a pair of diametrically opposed slots formed in the cylindrical insert, and the cylindrical receiver is shaped so as to define a receiving slot, and further wherein the coupling means comprises a lock member slidably positioned within the diametrical opposed slots of the cylindrical insert, the lock member including a through-extending aperture; and a threaded fastener directed through the lock member; a securing nut secured to the cylindrical insert and threadably engaged to the threaded fastener, whereby an axial advancing of the threaded fastener into the securing nut will effect securement of the lock member.

2. The bowling ball finger insert of claim 1, wherein the lock member is shaped so as to define an engaging slot within which a tool can be positioned to bias the lock member through one of the opposed slots in the cylindrical insert and into the receiving slot formed in the cylindrical receiver.

3. The bowling ball finger insert of claim 2, wherein the cylindrical insert is shaped so as to define a plurality of guide projections extending from a bottom surface thereof, and further wherein the cylindrical receiver is shaped so as to define a pair of cooperatively configured apertures within which the guide projections are received.

4. The bowling ball finger insert of claim 3, wherein the cylindrical receiver is shaped so as to define a polygonal aperture within which the securing nut is received.

5. The bowling ball finger insert of claim 4, wherein the lock member is shaped so as to define an inclined upper surface extending over the center aperture through which the threaded fastener, the inclined upper surface being operable to encourage positioning of the lock member into the receiving slot during securement of the coupling means.

6. The bowling ball finger insert of claim 5, wherein the cylindrical insert has an inside diameter permitting reception of a digit of a human hand therewithin.

7. The bowling ball finger insert of claim 6, and further comprising a plurality of cylindrical inserts, each of the cylindrical inserts having a disparate interior diameter.

* * * * *